US005766329A

United States Patent [19]

LaSalle et al.

[11] Patent Number: 5,766,329

[45] Date of Patent: Jun. 16, 1998

[54] INERT CALCIA FACECOATS FOR INVESTMENT CASTING OF TITANIUM AND TITANIUM-ALUMINIDE ALLOYS

[75] Inventors: Jerry Capriotti LaSalle, Montclair; Anthony Joseph Fanelli, Rockaway, both of N.J.; Eoin Joseph Barry, Limerick, Ireland; Brian Jeffrey Snow, Parsippany, N.J.

[73] Assignee: AlliedSignal Inc., Morristown, N.J.

[21] Appl. No.: 644,598

[22] Filed: May 13, 1996

[51] Int. Cl.[6] ..... B22C 1/06; B22C 1/18; B28B 7/28; B28B 7/34

[52] U.S. Cl. ..... 106/38.9; 106/38.22; 106/38.27; 164/517; 164/518; 164/519; 164/525; 164/529

[58] Field of Search ..... 106/38.27, 38.22, 106/38.9, 38.2; 501/123; 420/418; 164/335, 517, 518, 519, 525, 529, 516, 520; 264/219

[56] References Cited

U.S. PATENT DOCUMENTS

| | | | |
|---|---|---|---|
| 4,108,931 | 8/1978 | Ogden | 106/38.2 |
| 4,703,806 | 11/1987 | Lassow et al. | 164/518 |
| 4,710,481 | 12/1987 | Degawa et al. | 501/123 |

*Primary Examiner*—Michael Marcheschi
*Attorney, Agent, or Firm*—Felix L. Fischer

[57] ABSTRACT

A calcia mold facecoat is applied to a mold for casting parts composed of reactive metals such as titanium and titanium aluminide. The facecoat is composed of a calcium carbonate based slurry comprising a dense grain calcium carbonate powder and an aqueous based binder. It is applied to a wax or plastic pattern used in the lost wax process for fabricating a casting shell. The mold is built using multiple dipping of alumina-silicate slurries, and then fired at high temperatures in an oxygen rich environment. The metal part is cast before the fired mold can cool below about 800° C. Organometallic based slurry binders are avoided and significant cost savings are realized owing to the benign nature of the aqueous based suspensions with respect to the environment.

11 Claims, 3 Drawing Sheets

INERT CALCIA FACECOATS FOR INVESTMENT CASTING OF TITANIUM AND TITANIUM-ALUMINIDE ALLOYS

BACKGROUND OF THE INVENTION

1. Field of the Invention

The present invention relates to mold facecoats for use in the casting of reactive metals, particularly complex shapes thereof.

2. Description of the Prior Art

Melting and casting of reactive metals such as titanium or titanium aluminides is difficult due to the molten metal's affinity for elements such as oxygen, nitrogen and carbon. At elevated temperatures necessary for casting, titanium and titanium aluminides react with ceramic facecoats, for example zirconia and zircon, commonly used in the casting for Fe or Ni based alloy components. The reaction of molten titanium and titanium aluminides can result in rough surface quality as well as the formation of a brittle alpha phase at the surface of the component. The brittle surface layer results in premature crack formation and a deleterious reduction in mechanical properties and component surface life.

Removal of the brittle surface layer can be accomplished by mechanical and/or chemical methods of polishing. However, this adds cost to the component and is frequently impractical due to the complexity of shape or difficulty in maintaining dimensional tolerance.

Formation of the brittle surface layer in cast titanium and titanium aluminide components can be done using thermodynamically stable facecoats. Few facecoats exist which have the necessary stability compared with molten titanium and titanium aluminides. Candidate facecoat materials include yttria ($Y_2O_3$), thoria ($ThO_2$), calcia (CaO) and other exotic rare earth oxides. Thoria is radioactive and suffers from poor thermal shock resistance. For this reason it has not been exploited industrially. Yttria is a strong candidate and has been pursued as a facecoat material by a number of investigators. U.S. Pat. No. 4,703,806 to Lassow et al. discloses a yttria slurry for the casting of reactive metals. The slurry performs well but suffers from high raw material cost. Present costs of yttria are approximately $60/lb. Zircon, a facecoat widely used for nickel castings, is less than $1/lb. Since titanium and titanium aluminide castings compete with nickel castings in a wide variety of applications, the high cost of a yttria facecoat effectively prices titanium and titanium aluminide castings out of the market. This is particularly important for cost sensitive applications, for example automotive applications.

Calcia is also a potential refractory material for titanium and titanium aluminides due to its thermal stability. U.S. Pat. No. 4,710,481 to Degawa et. al. discloses melting titanium and titanium alloys in calcia crucibles. However, calcia is highly hydrophilic and spontaneously hydrates in ambient levels of atmospheric moisture. The hydration is accompanied by volume changes which cause cracking and spallation. Calcia crucibles can spontaneously crack after only hours of exposure to atmospheric moisture. For this reason calcia is an impractical material for commercial, industrial environments.

SUMMARY OF THE INVENTION

The present invention provides an industrially practical, low cost facecoat for the fabrication of molds used to cast titanium and titanium aluminide metals, which overcomes the above-mentioned drawbacks. The facecoat of the invention also finds application for other reactive metal castings, for example zirconium alloy castings.

A specific object of this invention is to provide a low cost, industrially practical facecoat comprising calcia for casting reactive and non-reactive metals. The calcia facecoat is formed in-situ by heating a calcium carbonate precursor facecoat.

A further object of this invention is to provide a calcia mold facecoat for use in the fabrication of molds for casting reactive metals such as titanium and titanium aluminide which reduces or eliminates reactivity between mold and the reactive metal. The calcia facecoat is, again, derived from a calcium carbonate precursor facecoat.

Another object of this invention is to provide a calcium carbonate based slurry mold facecoat which can be applied relatively smoothly and evenly to a wax or plastic pattern used in the lost wax process for fabricating casting shells for casting reactive metals such as titanium and titanium aluminide. The calcium carbonate will transform upon heating into a calcia based facecoat.

A further objective of this invention is to provide a method for producing high precision investment castings of reactive metals, such as titanium and its alloys, and non-reactive metals, such as nickel and its alloys, at a lower cost than previous techniques.

A still further objective is the reduce or eliminate the amount of surface grinding or chemical milling required to produce precision investment castings of reactive metals such as titanium and titanium aluminide.

Additional objects and advantages of the invention will be set forth in part in the description which follows, and in part will be obvious from the description, or may be learned by practice of the invention. The objects and advantages of the invention may be realized and obtained by means of instrumentality's and combinations particularly pointed out in the appended claims.

To achieve the objects in accordance with the purpose of the invention, as embodied and broadly described herein, the invention comprises a method of using a calcium carbonate based slurry comprising a dense grain calcium carbonate powder and an aqueous based binder as a mold facecoat in the fabrication of molds for casting reactive metals.

To further achieve the objects and in accordance with the purpose of the invention, as embodied and broadly described herein, the invention comprises a method of fabricating a casting shell for casting reactive metals comprising the steps of, preparing a pattern; dipping the pattern in a calcium carbonate based slurry comprised of a dense grained calcium carbonate powder and an aqueous based binder; building a mold using multiple dipping of alumina-silicate slurries; firing the mold at high temperatures in an oxygen rich environment; and casting the metal part before the fired mold can cool below about 800° C.

Another objective of the invention is to avoid the use of organometallic based slurry binders such as metal alkoxide or chelates which are environmentally hazardous. By using aqueous based suspension, significant cost savings occur resulting from the benign nature of the suspensions with respect to the environment.

This procedure takes advantage of the well known chemical transformation of calcium carbonate to calcia at temperatures above about 750° C. At these high temperatures the newly formed calcia does not hydrate. Since the metal casting is done before the mold cools, the hydration of the calcia is prevented, allowing the non-reactive calcia facecoat to be advantageously utilized. As a secondary benefit, sequential operation of mold firing then immediate casting results in reduced energy needs and fast manufacturing throughput.

BRIEF DESCRIPTION OF THE DRAWINGS

The invention will be more fully understood and further advantages will become apparent when reference is made to the following detailed description of the preferred embodiments of the invention and the accompanying drawings in which.

DESCRIPTION OF THE PREFERRED EMBODIMENTS

Figure 1:
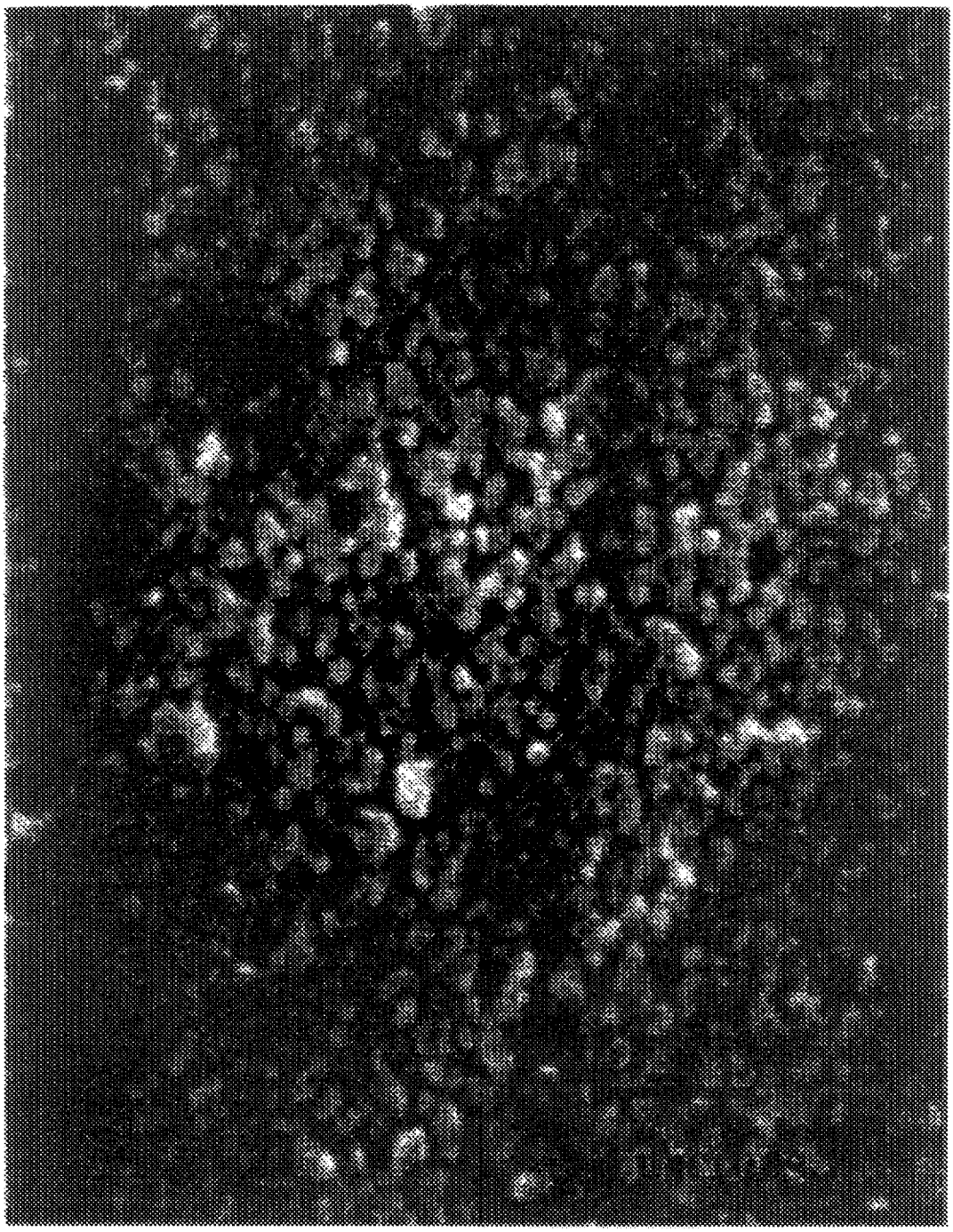
FIG. 1 is an SEM micrograph of a "green" calcium carbonate coating

In accordance with the present invention, a calcium carbonate based slurry comprising a calcium carbonate powder and an aqueous binder is used as a mold facecoat in the fabrication of molds for casting reactive metals. As used herein, the term "reactive metals" means metals such as titanium, titanium alloys and titanium aluminides which have a high negative free energy of formation for the oxide, nitride and carbide of the metal. As embodied herein the reactive metals include but are not limited to titanium and its alloys, titanium aluminides, and zirconium and its alloys. The invention also pertains to non-reactive metals such as nickel and its alloys. While existing facecoat materials, for example zircon, have extensive commercial success in nickel casting, the calcium carbonate to calcia conversion process offers a cost advantage due to the low raw material cost of calcium carbonate.

For the purposes of the present invention, the aqueous based binder preferably has both a low temperature green strength and is a high temperature ceramic binder. Preferably, the aqueous based binder is a colloidal suspension of inorganics, for example zirconia, titania, hafnia, or silica For the purposes of the present invention, the aqueous based binder may also include additional additives or solvents to effect other desirable characteristics such as to control the viscosity of the binder or adjust the pH.

In accordance with a preferred embodiment of the present invention, the calcium carbonate based slurry, comprising a calcium carbonate powder and a tailored aqueous based binder, is used to form a mold facecoat in the fabrication of an investment casting shell by the "lost wax" process. As embodied herein, a pattern made of wax or plastic having the shape of the desired casting is prepared and dipped in the calcium carbonate based slurry. After allowing the dipcoat layer to partially dry and/or cure, alternate layers of ceramic stucco and dipcoat are applied until a shell of desired thickness is formed. The mold is allowed to dry thoroughly, and then the mold is fired at temperatures near 1000° C. for a period of no less than 0.5 hour in an oxidizing atmosphere such as air. The firing results in the complete volatilization of the pattern in a manner familiar to those skilled in the "lost wax" art. The firing also has an additional purpose of converting the green calcium carbonate facecoat into a calcia facecoat. The mold is then transferred to a casting chamber while hot and the mold is filled with molten metal with the assistance of gravity, pressure or centrifugal force or other techniques familiar to those skilled in the art. The metal is allowed to cool. After cooling, the cast metal, now in the shape of the original pattern is removed from the pattern. By using the mold while still above about 750° C. from the firing, the deleterious hydration of calcia is prevented, resulting in a low cost, inert facecoat comprising of unhydrated calcia.

The following examples are presented to provide a more complete understanding of the invention. The specific techniques, conditions, materials, proportions and reported data set forth to illustrate the principles and practice of the invention are exemplary and should not be construed as limiting the scope of the invention.

EXAMPLE I

This example illustrates the production of a calcium oxide facecoat using a calcium carbonate slurry precursor. A calcium carbonate slurry was made by ball milling 1700 grams of calcium carbonate, 233.5 grams of colloidal silica binder (LUDOX REMET 30), 550 grams of de-ionized water and 45 grams of DARVAN 821A dispersant. Ball milling was accomplished with the addition of 7354 grams of 0.375 inch zirconia cylinders. Milling was done for 2.5 hours. Viscosity was then measured using a Brookline II viscometer. Viscosity was adjusted by the addition of calcium carbonate powder or xanthum gum and the ball milling resumed. Milling, viscosity measurement and adjustment were done periodically for a total of 20 hours to attain a target viscosity of between 50 and 100 as measured by the Brookline II viscometer. The pH and particle size were also monitored with a target pH of 9.5 and a target particle size of 0.3 to 3 micrometers. The pH was adjusted by adding either sodium hydroxide to raise the pH or TMA (tetramethyl ammonium hydroxide).

The purpose of ball milling the slurry is to de-agglomerate the calcium carbonate powder. The de-agglomeration results in the suppression of cracks during drying. It also has a secondary effect in that the "hiding" power of the coating is greatly enhanced.

Figure 2:
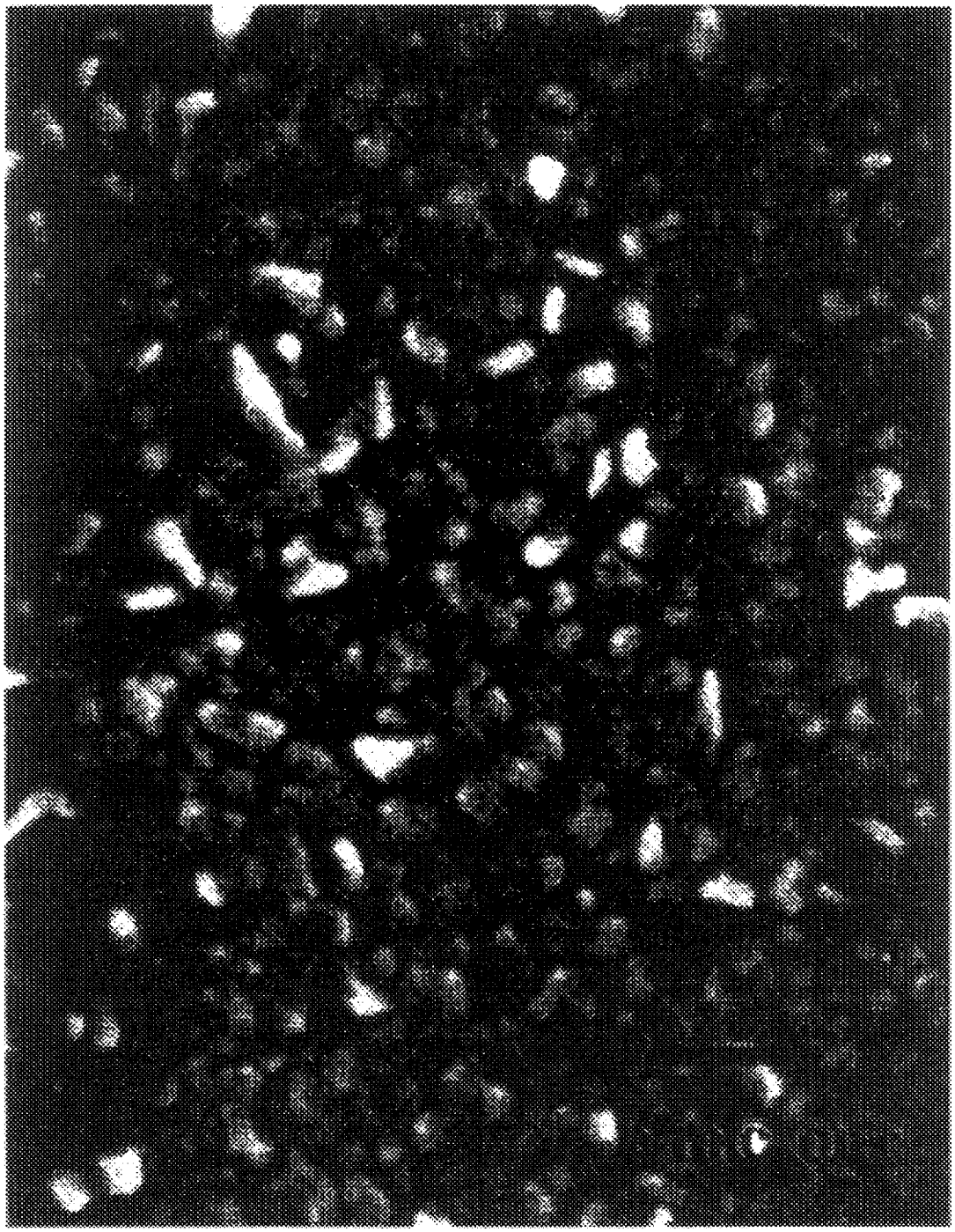
FIG. 2 is an SEM micrograph of a coating after it has been transformed to calcium oxide.

The solution is next applied to a substrate and allowed to dry at ambient temperature to form a "green" calcium carbonate coating, shown in FIG. 1. That coating is next heated to 1000° C., transforming it to an adherent calcium oxide coating, shown in FIG. 2.

EXAMPLES 2–10

Examples 2–10 were produced identical to example 1 except that they used a different binder from the colloidal silica or no binder at all. The compositions are listed in Table I.

TABLE I

| SLIP # | BASE SOLID g | BINDER g | $H_2O$ g | DARVAN 821A g | MILLING hrs | pH |
|---|---|---|---|---|---|---|
| 105-A | $CaCO_3$ 350 | Zr. PROPIONATE 36 | 158.6 | 64 | 23.5 | 7.5 |
| 107 | $CaCO_3$ 1696 | Zr. AMON. CARB. solution-250 | 502 | 140 | 23 | 9.8 |
| 108 | $CaCO_3$ 1606 | Zr. AMON. CARB. solution-500 | 384 | 140 | 20 | 9.5 |
| 102D | $CaCO_3$ 1800 | LUDOX REMET 30 233.5 | 550 | 45 | 22.5 | 9.2 |

TABLE I-continued

| SLIP # | BASE SOLID g | BINDER g | $H_2O$ g | DAR-VAN 821A g | MILL-ING hrs | pH |
|---|---|---|---|---|---|---|
| 110 | $CaCO_3$ 1906 | ZIRCONIUM OXIDE-50 | 582 | 50 | 28 | 9.1 |
| 111 | $CaCO_3$ 1928 | ZIRCONIUM OXIDE-120 | 733 | 60 | 23 | 9.3 |
| 112 | $CaCO_3$ 2035 | YTTRIUM NITRATE 126 | 1085 | 226 | 22 | 8.2 |
| 113 | $CaCO_3$ 1928 | YTTRIUM NITRATE 251 | 1156 | 420 | 23 | 7.6 |

EXAMPLE 11

Figure 3:
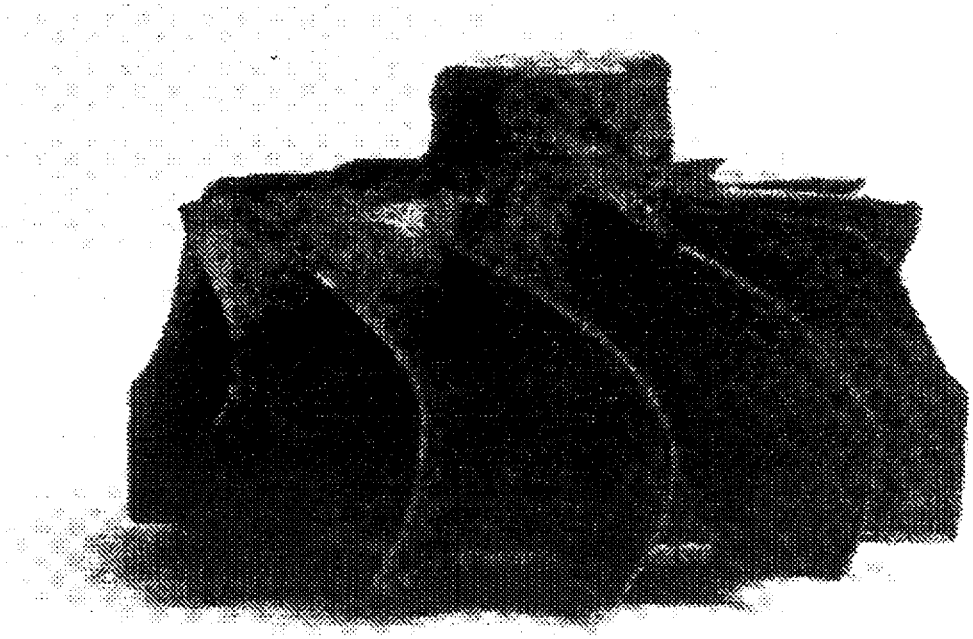
FIG. 3 is a photograph of a γ-TiAl rotor produced from the in-situ formed calcium oxide facecoat.

A calcium carbonate slurry as described in Example 1 is made and applied to a polystyrene preform of a turbocharger rotor by dipping the rotor. The coating is allowed to dry under ambient conditions, forming a facecoat on the turbocharger rotor pattern. It is subsequently redipped multiple times into backup coatings of flintgrains and alumina silicate powders to form a standard investment mold. Such techniques are widely used and understood in the investment cast industry. The completed investment mold is next passed through a furnace at between 900° and 1100° C. to melt the plastic preform and simultaneously transforming the calcium carbonate facecoat into a calcium oxide. The still hot mold is next filled with a suitably sized charge of titanium-aluminide alloy, placed in a vacuum and inductively melted and cast into the turbocharger rotor cavity. Since the mold is always held above about 800° C. prior to the cast, the facecoat remains calcium oxide which is inert to molten titanium aluminide alloy. This prevents the hydration of calcium oxide which would occur at room temperature, destroying the non-reactive nature of the facecoat. Such a calcium oxide facecoat could not be otherwise formed by room temperature processes since the calcium oxide in an ambient environment would hydrate, rendering it unusable as a facecoat material. The in-situ transformation of calcium carbonate to calcium oxide during the removal of the plastic pattern and its immediate use by casting represents a novel aspect of the invention. A photograph of the cast TiAl rotor made from this process is shown in FIG. 3.

Having thus described the invention in rather full detail, it will be understood that such detail need not be strictly adhered to but that various changes and modifications may suggest themselves to one skilled in the art, all falling within the scope of the present invention as defined by the subjoined claims.

What is claimed is:

1. A method for producing a mold having a calcium oxide facecoat for use in casting molten metal, process comprising the steps of:

forming a facecoat slurry comprising a calcium carbonate power and an aqueous inorganic binder;

applying the slurry to a casting pattern;

forming a casting shell over the casting pattern to create a mold;

firing the mold; and transferring the mold to a casting chamber.

2. A method as defined in claim 1 wherein the step of firing the mold is conducted at about 1000° C. for greater than 0.5 hour.

3. A method as defined in claim 2 wherein the step of firing is conducted in an oxidizing atmosphere.

4. A method as defined in claim 1 wherein the step of transferring the mold is accomplished while the temperature of the mold (from the firing step) is greater than about 750° C.

5. A method as defined in claim 1 wherein the step of firing the mold is conducted at a temperature sufficient to convert the calcium carbonate facecoat into a calcia facecoat.

6. A method as defined in claim 1 wherein the aqueous binder is colloidal suspension.

7. A method as defined in claim 6 wherein the inorganic colloidal suspension comprise inorganic materials selected from the group of zirconia, titania, hafnia, or silica.

8. A method as defined in claim 1 wherein the step of forming a casting shell comprises the steps of:

allowing the slurry to partially dry; and applying a ceramic stucco laminate to form a shell for the mold.

9. A method as defined in claim 8 wherein the step of applying a ceramic stucco laminate comprises applying alternate layers comprising ceramic stucco and slurry.

10. A method as defined in claim 1 wherein the molten metal for casting comprises a reactive metal.

11. A method as defined in claim 8 wherein the reactive metal is selected from the group of titanium, titanium-aluminide, zirconium, alloys of titanium or alloys of zirconium.

* * * * *